US006717889B2

(12) United States Patent
Sung

(10) Patent No.: US 6,717,889 B2
(45) Date of Patent: Apr. 6, 2004

(54) CLOCK WITH LUMINOUS DECORATION

(76) Inventor: Yuan-Chi Sung, 3rd Fl., No. 5, Lane 337, Yungho Rd., Chungho City, Taipei Hsien (TW)

( * ) Notice: Subject to any disclaimer, the term of this patent is extended or adjusted under 35 U.S.C. 154(b) by 315 days.

(21) Appl. No.: 10/010,841

(22) Filed: Dec. 5, 2001

(65) Prior Publication Data

US 2003/0090964 A1 May 15, 2003

(30) Foreign Application Priority Data

Nov. 14, 2001 (TW) ..... 90219596 U

(51) Int. Cl.[7] ..... G04B 19/30; G04B 19/32
(52) U.S. Cl. ..... 368/67; 368/226; 368/227
(58) Field of Search ..... 368/67, 223, 226–232

(56) References Cited

U.S. PATENT DOCUMENTS 5,548,565 A * 8/1996 Aoyama et al. ..... 368/227
5,604,716 A * 2/1997 Cheung ..... 368/67
6,366,539 B1 * 4/2002 Liao ..... 368/227
6,487,143 B1 * 11/2002 Kaelin ..... 368/227

* cited by examiner

*Primary Examiner*—Vit W. Miska
(74) *Attorney, Agent, or Firm*—Jackson Walker, LLP

(57) ABSTRACT

A clock has a luminous decoration member provided on a dial of the clock. The luminous decoration member is made of a transparent material and formed in an annular shape having multiple lightings fitted therearound. A layer of fluorescent material is applied on a rear side of the luminous decoration member. Whereby when the lightings are providing light on the luminous decoration member, the fluorescent material applied on the luminous decoration member is lit so as to emit colorful fluorescence to the surroundings thereof. Therefore, a user can easily observe the dial and clock hands of the clock in the dark or night.

5 Claims, 6 Drawing Sheets

CLOCK WITH LUMINOUS DECORATION

BACKGROUND OF THE INVENTION

1. Field of the Invention

The present invention relates to a clock with luminous decoration provided on a dial to light the dial and clock hands so that a viewer can easily tell the time at night or other times of darkness.

2. Description of Related Art

Conventionally, a clock is a device other than a watch for indicating or measuring time commonly by means of hour, minute and second hands moving on a dial. However, the time cannot normally be seen on a conventional clock in darkness or night.

Therefore, it is an objective of the invention to provide a clock with luminous decoration provided on a dial thereof to mitigate and/or obviate the aforementioned problems.

SUMMARY OF THE INVENTION

The main object of the present invention is to provide a clock with a luminous decoration member fixedly mounted on a dial of the clock. The luminous decoration member is made of a transparent material and formed in an annular shape having multiple lightings fitted therearound. A layer of fluorescent material is applied on a rear side of the luminous decoration member. Whereby when the luminous decoration member is exposed to light emitted from the lightings, the fluorescent material applied on the luminous decoration member is lit so as to emit colorful fluorescence to the surroundings thereof. Therefore, a viewer can easily see the dial and clock hands of the clock in the dark or night.

Other objects, advantages and novel features of the invention will become more apparent from the following detailed description when taken in conjunction with the accompanying drawings.

DETAILED DESCRIPTION OF THE PREFERRED EMBODIMENT

Figure 1:
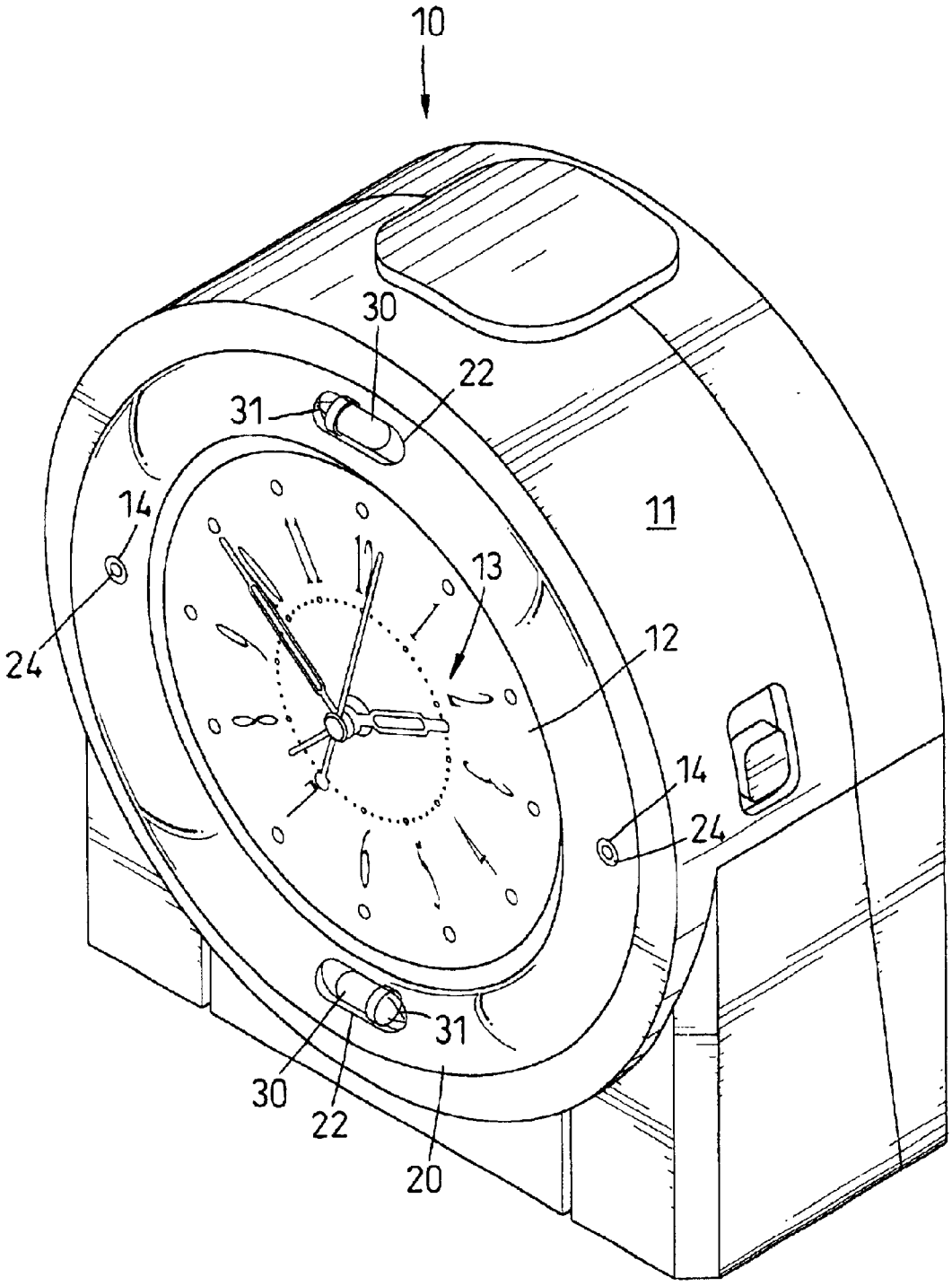
FIG. 1 is a perspective view of a clock with luminous decoration in accordance with the invention.
Figure 2:
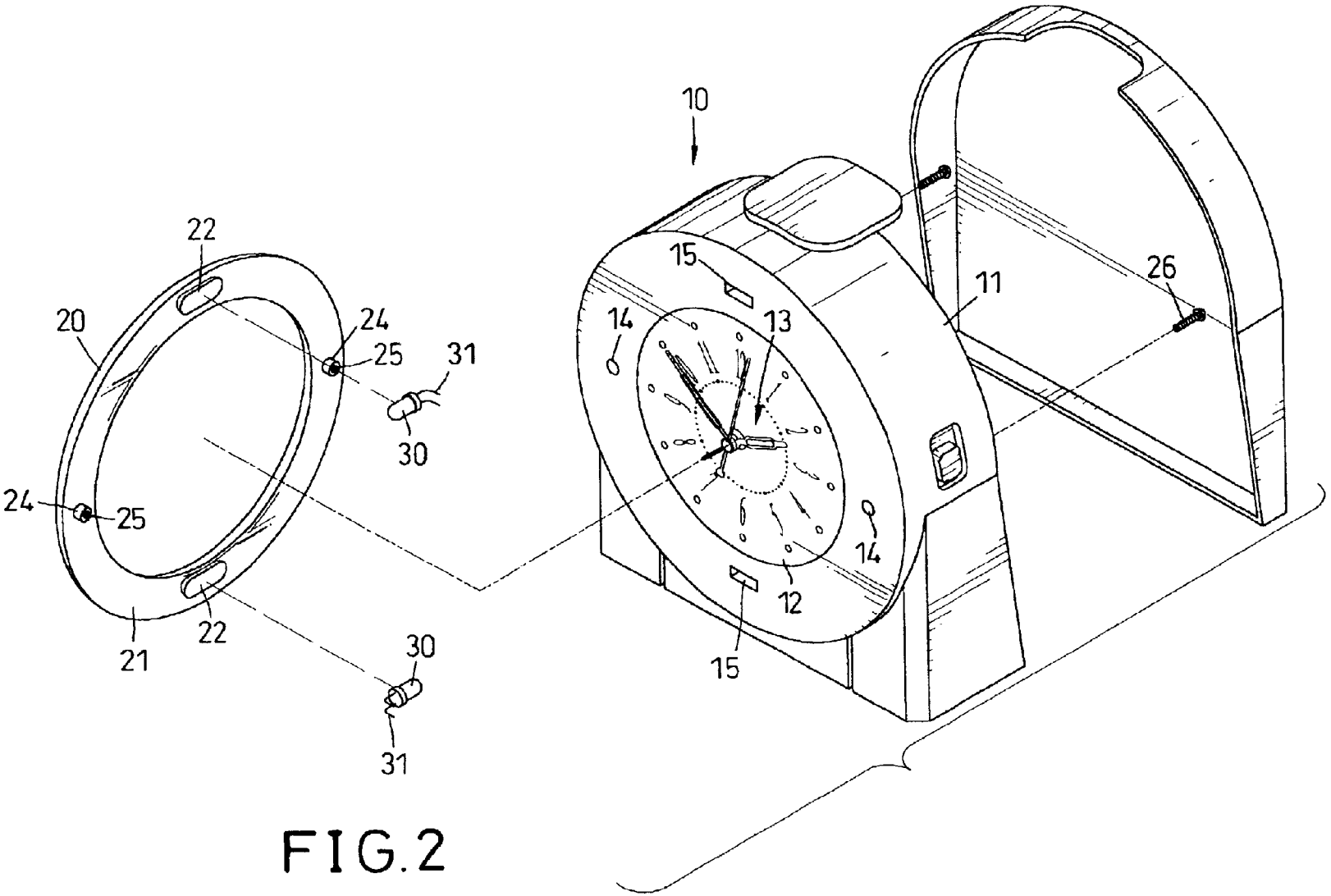
FIG. 2 is an exploded perspective view of the clock with luminous decoration in accordance with the invention.

As shown in FIGS. 1 and 2, the present invention relates to a clock (10) having a housing (11), a dial (12) and clock hands (13) moving on the dial (12), and particularly having a luminous decoration member (20) provided on the dial (12).

The dial (12) is defined with multiple equal-spaced positioning holes (14) distributed around a peripheral edge thereof, and multiple equal-spaced through holes (15) also distributed around the peripheral edge thereof.

The luminous decoration member (20) is optionally made of transparent material and formed in an annular shape having multiple equal-spaced recesses (22) defined therein corresponding to the multiple through holes (15) and multiple equal-spaced positioning posts (24) formed thereon corresponding to the multiple positioning holes (14). A layer of fluorescent material (21) is applied on a rear side of the luminous decoration member (20).

Multiple lightings (30) are respectively fitted in the multiple recesses (22). Each one of the lightings (30) has two terminal pins (31) extended through the through hole (15) and electrically connected to terminals of a power supply provided in the housing (11).

Figure 3:
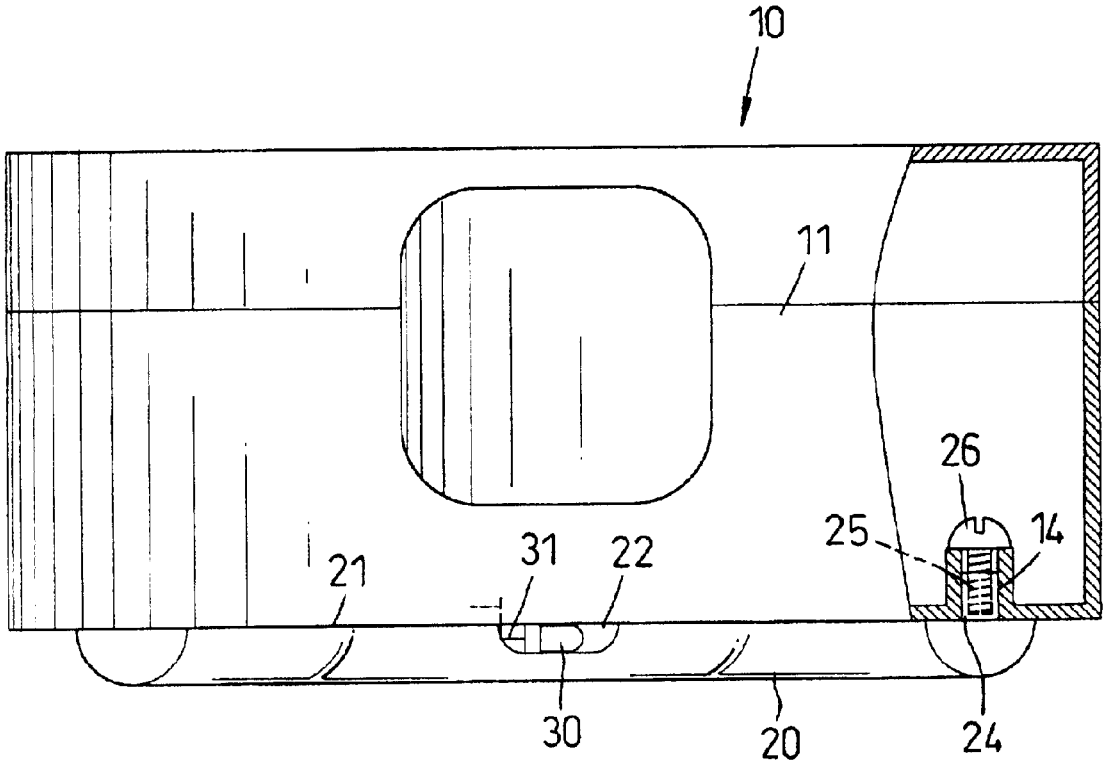
FIG. 3 is a partial cross sectional view of the clock in accordance with the invention.

With reference to FIG. 3 the rear side of the luminous decoration member (20) is abutted against a front side the dial (12) and fixed on the dial (12) by means of positioning posts (24) respectively fixed into the positioning holes (14). Multiple fasteners (26) are respectively threaded into internal threads (25) defined in the multiple positioning posts (24).

The lightings (30) are optionally light-emitting diodes with identical or different colors. When the lightings (30) are providing or emitting identical light or colorful lights on the luminous decoration member (20), the fluorescent material (21) applied on the luminous decoration member (20) is lit so as to emit fluorescence to the surroundings thereof. Therefore, the dial (12) and the clock hands (13) can be easily observed in the dark or night.

Figure 4:
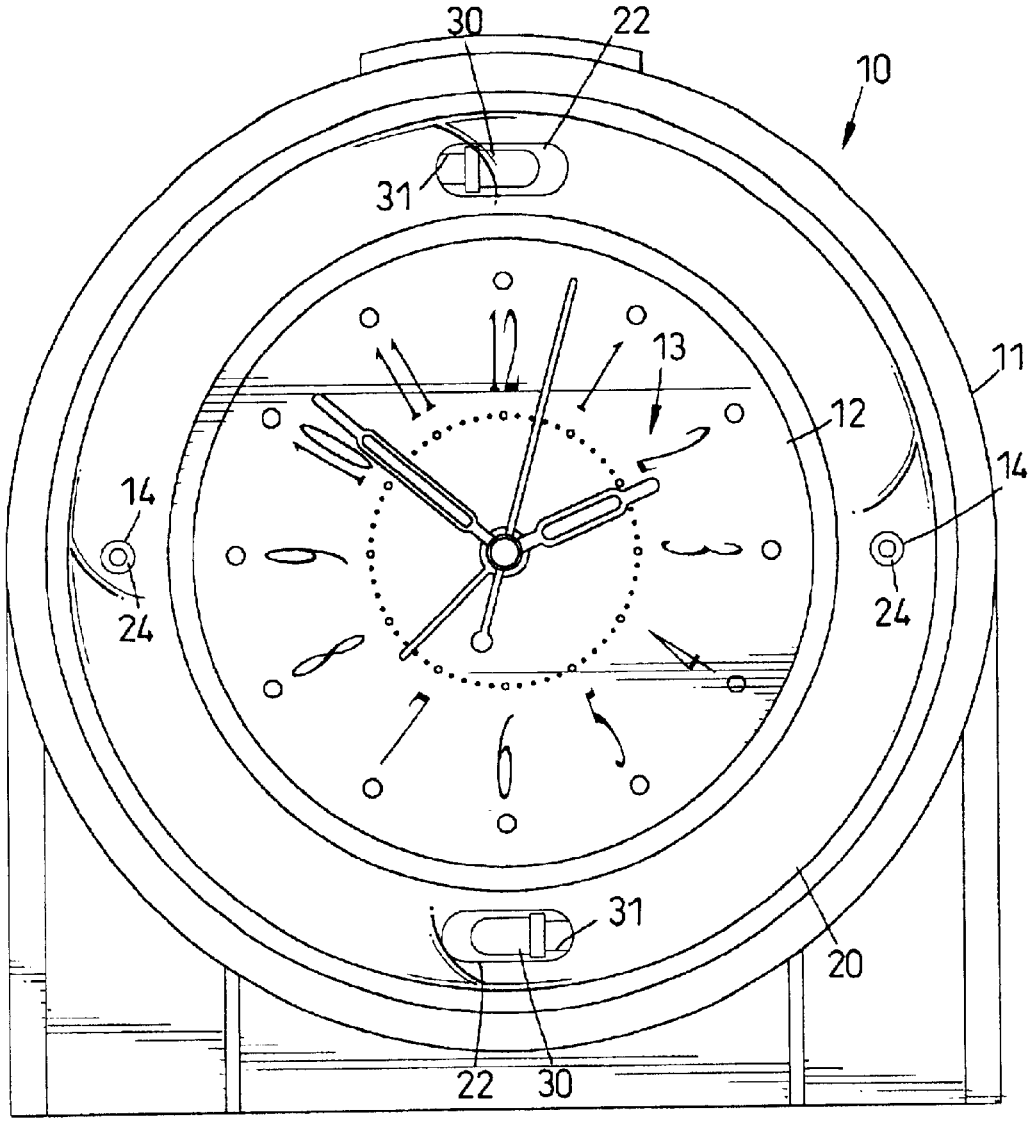
FIG. 4 is a front side view of a first embodiment of the clock in accordance with the invention.
Figure 5:
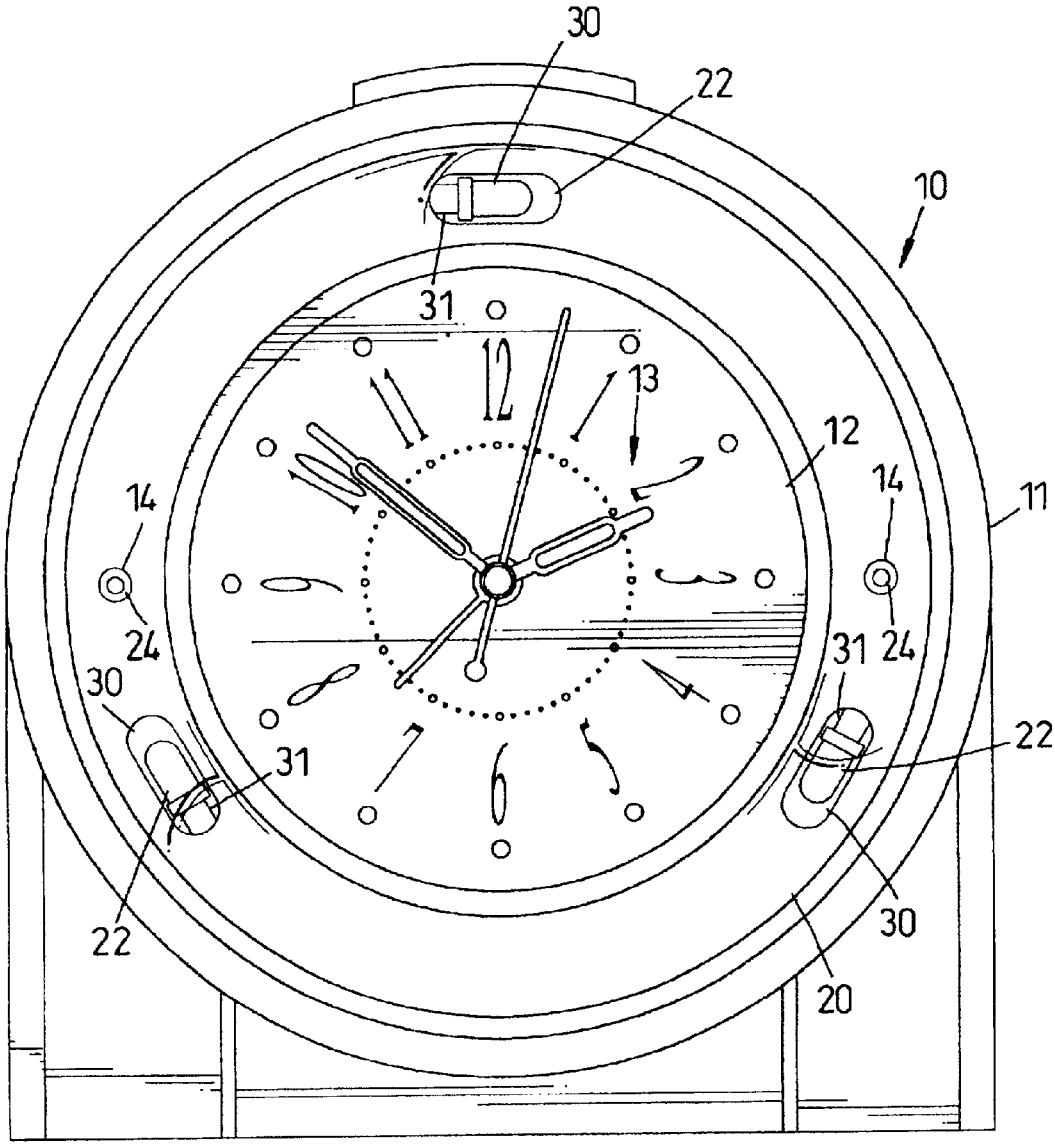
FIG. 5 is a front side view of a second embodiment of the clock in accordance with the invention.
Figure 6:
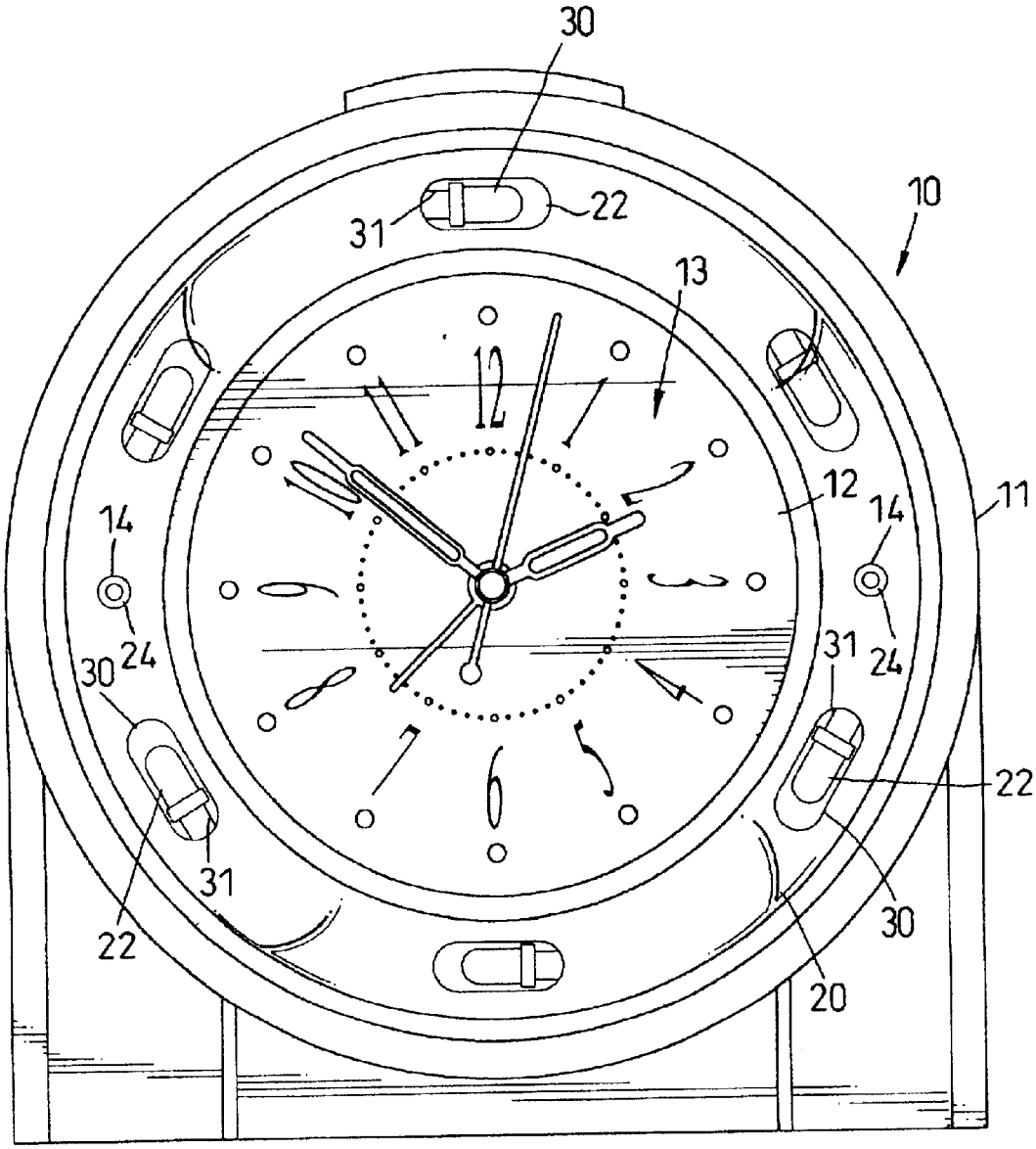
FIG. 6 is a front side view of a third embodiment of the clock in accordance with the invention.

As shown in FIG. 4, a first embodiment of the clock (10) of the invention comprises two of the lightings (30) fitted in the luminous decoration member (20). As shown in FIG. 5, a second embodiment of the clock (10) of the invention comprises three of the lightings (30) provided around the luminous decoration member (20). As shown in FIG. 6, a third embodiment of the clock (10) of the invention comprises six of the lightings (30) provided around the luminous decoration member (20).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A clock (10) with a luminous decoration member (20) provided thereon, the clock (10) having a housing (11) and a dial (12) with clock hands (13) moving thereon, wherein the luminous decoration member (20) is formed in an annular shape and fixedly mounted on a front side of the dial (12);

a layer of fluorescent material (21) is applied on a rear side of the luminous decoration member (20); and multiple lightings (30) are respectively fitted in equal-spaced multiple recesses (22) defined around the luminous decoration member (20).

2. The clock (10) as claimed in claim 1, wherein the multiple lightings (30) are light-emitting diodes, each one of which has two terminal pins (31) electrically connected to terminals of a power supply provided in the housing (11).

3. The clock (10) as claimed in claim 1, wherein the luminous decoration member (20) is made of a transparent material.

4. The clock (10) as claimed in claim 1, wherein the luminous decoration member (20) is formed with multiple equal-spaced positioning posts (24) corresponding to multiple equal-spaced positioning holes (14), whereby the luminous decoration member (20) is fixedly mounted on the dial (12) by means of positioning posts (24) respectively fixed into the positioning holes (14).

5. The clock (10) as claimed in claim 1, wherein multiple fasteners (26) are respectively threaded into internal threads (25) defined in the multiple positioning posts (24).

* * * * *